US007231913B2

(12) United States Patent
Wilson

(10) Patent No.: US 7,231,913 B2
(45) Date of Patent: Jun. 19, 2007

(54) BALL THROWING AND PITCHING MACHINE FEEDER DEVICE

(76) Inventor: Orville Wilson, 20215 Prince Creek, Katy, TX (US) 77450

( * ) Notice: Subject to any disclaimer, the term of this patent is extended or adjusted under 35 U.S.C. 154(b) by 0 days.

(21) Appl. No.: 11/184,642

(22) Filed: Jul. 19, 2005

(65) Prior Publication Data

US 2006/0016442 A1 Jan. 26, 2006

Related U.S. Application Data

(60) Provisional application No. 60/589,278, filed on Jul. 20, 2004.

(51) Int. Cl.
*F41B 4/00* (2006.01)

(52) U.S. Cl. ..... 124/78; 124/6

(58) Field of Classification Search ..... 124/6, 124/78

See application file for complete search history.

(56) References Cited

U.S. PATENT DOCUMENTS

| | | | | | |
|---|---|---|---|---|---|
| 1,211,738 | A | * | 1/1917 | Marty | 124/6 |
| 3,306,613 | A | * | 2/1967 | Mainers | 473/436 |
| 3,399,660 | A | * | 9/1968 | Swartout | 124/6 |
| 3,777,732 | A | * | 12/1973 | Holloway et al. | 124/78 |
| 4,372,284 | A | * | 2/1983 | Shannon et al. | 124/78 |
| 4,714,248 | A | * | 12/1987 | Koss | 473/436 |
| 6,089,217 | A | * | 7/2000 | Paulson et al. | 124/78 |

* cited by examiner

*Primary Examiner*—John A. Ricci
(74) *Attorney, Agent, or Firm*—David Fink

(57) ABSTRACT

A ball pitching device that, prior to release and delivery of the ball to a receiver, propels the ball through a circular loop or semi-circular arc in a manner that is visible to the receiver to simulate the path of a person's hand in the act of throwing. The invention enable a more realistic simulation of an overhand or side arm throwing motion as are commonly used for pitching baseballs and to also simulate the underhand throwing motion used in softball.

6 Claims, 5 Drawing Sheets

BALL THROWING AND PITCHING MACHINE FEEDER DEVICE

CROSS-REFERENCE TO RELATED APPLICATIONS

This application claims the benefit of U.S. Provisional Application No. 60/589,278, filed Jul. 20, 2004, entitled "Ball Throwing and Pitching machine Feeder Device".

STATEMENT REGARDING FEDERALLY SPONSORED RESEARCH OR DEVELOPMENT

This invention does not include any federally sponsored research or development.

BACKGROUND OF THE INVENTION

This invention relates to a pitching machine and, more particularly, to a ball pitching machine for pitching a baseball or softball or any other type of ball. Various forms of ball pitching machines are known in the prior art which are said to simulate the speed and trajectory of balls as if pitched by an actual person.

There is known in the prior art devices to throw or pitch baseballs and/or softballs to a receiver such as a batter or catcher. These devices include machines to hurl a ball using a mechanical arm or lever. The arm is rotated and the ball is thrown from one end of the arm. Other devices project a ball by striking it with a rod or lever. Some other devices use either; (a) one or more rotating contact wheels, (b) rapid release of gas or air, (c) sudden release of tension on a spring, or (d) some combination thereof, to set a ball in flight. These machines project the ball from a stationary or near stationary position to the receiver with no visual throwing motion or simulation of a human throwing motion.

These devices do not give the receiver of the ball the realistic sense of batting or catching a ball thrown by a human. The ball is accelerated rapidly, typically over the distance of only a few inches, and the batter or catcher does not see a throwing motion prior to release of the ball and has no chance to "time" or anticipate the throw as with a real pitcher.

BRIEF SUMMARY OF THE INVENTION

It is therefore the object of this invention to provide an improved ball-throwing device. A device that, prior to release and delivery of the ball to the receiver, propels the ball through a circular loop or semi-circular arc in a manner that is visible to the receiver to simulate the path of a person's hand in the act of throwing. It is an object of the invention to simulate an overhand or side arm throwing motion as are commonly used for pitching baseballs and to also simulate the underhand throwing motion used in softball. Additionally, it is the object of this invention to serve as an attachment to or ball feeder for another pitching machine, propelling a ball in a circular loop or semi-circular arc and simulating the throwing motion of a person immediately prior to injecting or feeding the ball into the other associated pitching machine.

A ball pitching apparatus, including a propelling mechanism for propelling a ball from a first entry point to a first exit point away from the pitching apparatus in a first direction. The apparatus having a ball track for introducing the ball to the first entry point of the propelling mechanism. The ball track has a second entry point dimensioned to receive the ball and a second exit point for the introduction of the ball to the propelling mechanism, wherein the ball track is dimensioned in a generally circular or semicircular shape and constructed such that at least a portion of the ball is visible throughout the length of the path from said second entry point to said second exit point. A frame support mechanism for supporting the propelling mechanism and the ball track and for aligning the second exit point with said first entry point. Wherein a receiver positioned at said first direction in a confronting relationship to the apparatus is able to see said portion as it is conveyed along the ball track, thereby enabling the receiver to anticipate a pitching of the ball in a manner similar to an anticipation that occurs with a live ball pitcher during a windup and release of a pitch.

DETAILED DESCRIPTION OF THE INVENTION

The embodiments of the invention disclosed use one or more sources to exert force or successive forces on a ball traveling through a track to rapidly propel it through the track to approximate and simulate the movement of a ball and the throwing motion of a human immediately prior to release of the ball. The invention solves the important problem of providing a more realistic environment for batting practice or catching practice for the batter or catcher to see the ball accelerate, as would be the case if the ball were thrown by a human. Seeing the motion and path of the ball, as simulated, provides a visual warning and timing mechanism prior to the ball being released. The invention may be used to throw or pitch a ball directly to a receiver and it also may be used to feed a ball into another device or pitching machine that in turn pitches the ball to the receiver.

Pitchers throw baseballs or softballs by stepping toward the target and propelling the ball with a circular or windmill motion of the arm. Baseballs are typically thrown overhand or side-arm with the ball traveling in an arc that approximates a semi-circular path prior to it being released. In fast pitch softball, the ball is thrown underhand with a windmill or circular motion. The receiver of the pitch, the catcher or batter, visually sees a throwing motion where the pitchers extended arm accelerates and releases the ball. This arm and hand motion are an essential and important part of the act of throwing the ball. The batter's or catcher's perception of this pre-release motion is an important visual warning. It enables the person who is attempting to bat or catch the ball to anticipate or time the release of the pitch, sense the direction of the throw and gauge the force applied and resulting speed of the ball. This important aspect of the invention is not found in known pitching machines.

Figure 1B:
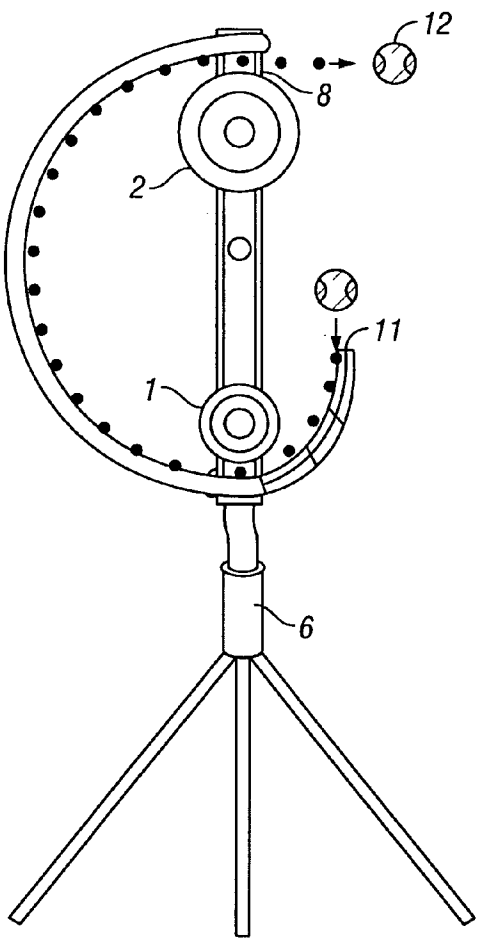
FIG. 1B is a perspective side view of an embodiment according to the invention.
Figure 1C:
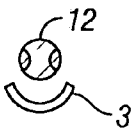
FIG. 1A is a perspective front view of an embodiment according to the invention.
Figure 1A:
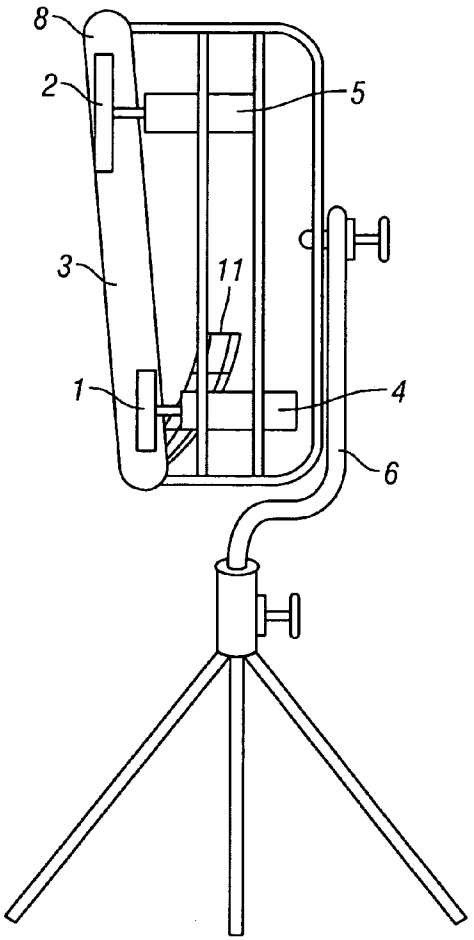

FIGS. 1A, 1B, and 1C show a baseball pitching machine according to the invention having a semi-circular ball track 3 with two contact wheels 1 and 2. Contact wheels 1 and 2 are attached to and rotated by two electric motors 4 and 5 and the track 3 is mounted vertically on a frame 6. As shown in the cross section illustration of FIG. 1*c*, the cross section of track 3 is a semicircle dimensioned to receive a baseball 12 and convey the baseball 12 from the entry point 8 to the exit point 11. The semicircular track 3 is concave with a rounded inside radius slightly larger than a standard baseball. The first contact wheel 1 is positioned near the ball entry point 11 of the track and the second contact wheel 2 is positioned near the exit point 8 of the track 3.

The first contact wheel 1 is positioned to engage a ball 12 that is introduced to entry point 11 and introduce a spinning force to the ball 12 to convey the ball 12 along track 3. Electric motor 4 transmits a clockwise rotational force to first contact wheel at a speed as to propel the ball 12 to the exit point 8 of the track 3.

The second contact wheel 2 is positioned close enough to the exit point 8 of track 3 to the bottom of the track 3 as to engage a ball 12 and exert a force on the ball 12 to convey the ball 12 through exit point 8 in a direction away from the pitching machine. Electric motor 5 transmits a clockwise rotational force to the second contact wheel at a speed sufficient to propel the ball 12 out of the exit point 8 of the track 3 away from the pitching device.

In operation of the device shown in FIGS. 1A and 1B, a ball is manually dropped into track 3 at entry point 11. The ball is gravity fed down track 3 until it is engaged by the first rotating contact wheel 1. The first contact wheel 1 then propels the ball upward in a circular arc through the ball track 3. Since the inside of the track is open, a batter or catcher positioned in confronting relationship to the pitching machine in the direction of the ball as it leaves exit point 8, sees the ball accelerate in a circular path similar the pitching motion of a person throwing a baseball over-hand. When the ball reaches second contact wheel 2, it is engaged by second contact wheel 2 and propelled out of the track 3 at exit point 8 in a direction away from the pitching machine.

The length and radius of the ball track 3 and the elevation of the track 3 from the ground provided by the frame 6 are intended to approximate the spatial motion of a ball in the hand of a typical person in the act of an over-hand throw. The track 3 shown in FIGS. 1*a*–1*c*, is an open track to enable a receiver in a confronting relationship to the pitching machine in the direction of the ball exiting exit point 8 to generally see the ball 12 as it is conveyed along the track 3. Track 3 could also be made from a tube of transparent material that is dimensioned to receive a baseball. Additionally, to accommodate other types of balls such as a standard softball a track 3 with a radius large enough to receive the ball could be used.

Figure 2A:
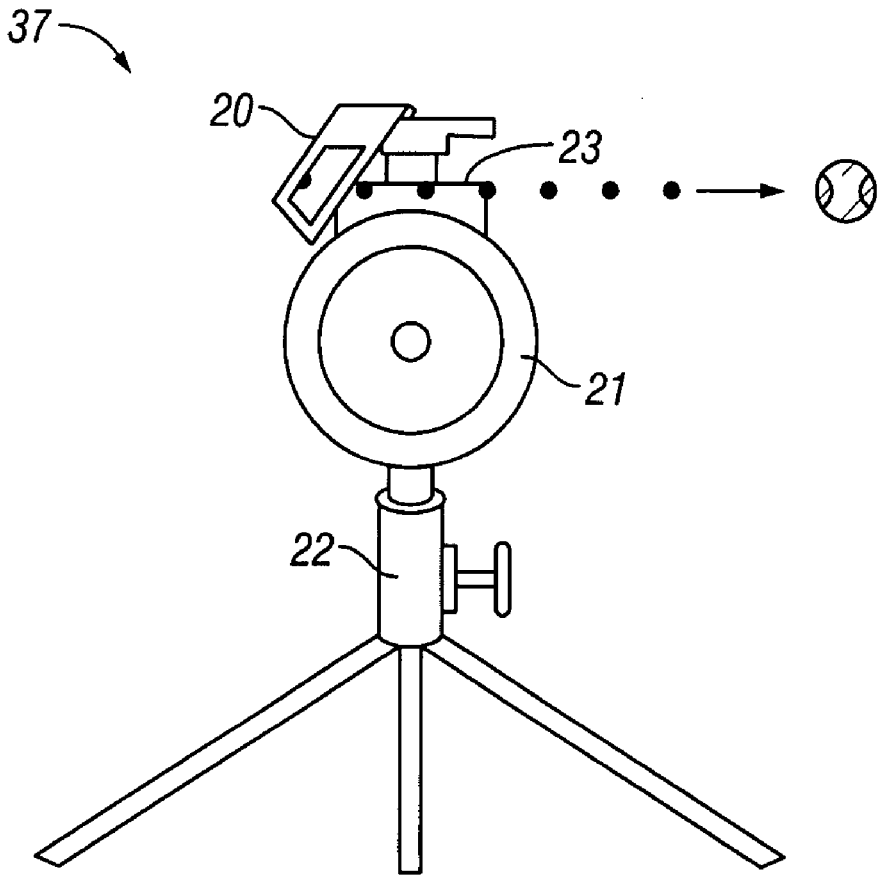
FIG. 2A is a perspective side view of a pitching machine known in the art.

FIG. 2A shows a fast pitch softball pitching machine 37 as known in the art having a frame 22 and a contact wheel 21 that rotates in a clockwise direction when a rotational force from an electric motor is received from shaft 24. A standard softball is introduced at entry point 20, and exits the machine at exit point 23 as the rotational force from contact wheel 21 propels the softball out of exit point 23 and away from pitching machine 37.

Figure 2C:
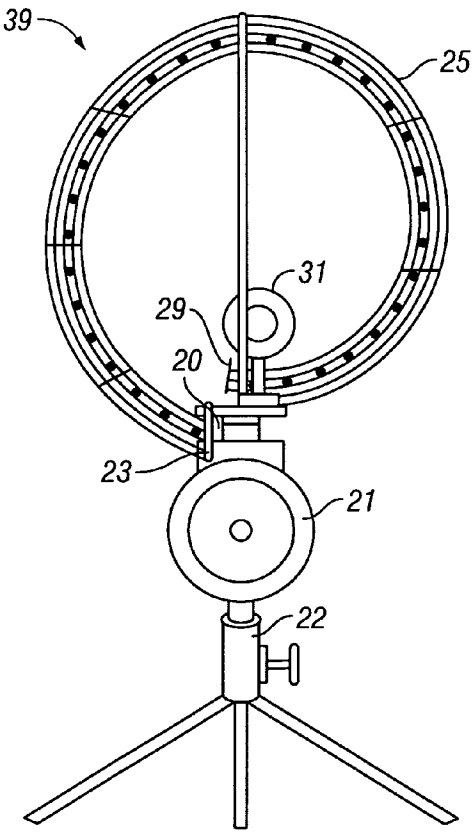
FIG. 2C is a perspective side view of an embodiment according to the invention.
Figure 2B:
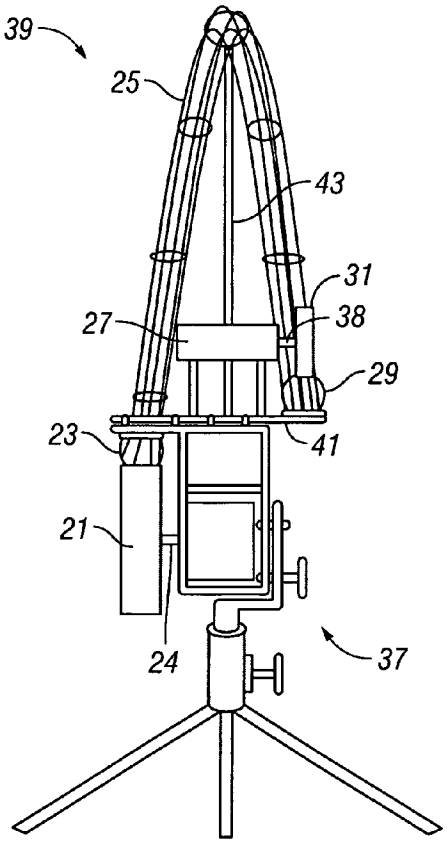
FIG. 2B is perspective front view of an embodiment according to the invention.

Another embodiment according to the invention discloses a pitching machine attachment 39 that is attached to a known pitching machine 37 such as the one shown in FIG. 2A. FIGS. 2B and 2C, show the embodiment of the pitching machine according to the invention with attachment 39. Pitching machine attachment 39 has a ball track 25 which is dimensioned and shaped to convey a ball in a circular motion from its entry onto ball track 25 at entry point 29 to its exiting ball track 25 at exit point 23 to be received into entry point 20 of the pitching machine 37. The circular path of a ball being conveyed by track 35 is meant to simulate the circular path of a pitcher's arm during the pitching of a softball Attachment 39 has a frame 41 to support the attachment 39 atop the pitching machine 37. A support rod 43 is attached to base 41 and to ball track 25 to stabilize and support ball track 25. Attachment 39 has a contact wheel 31 positioned near entry point 29 to engage a ball and propel it around the track 25. Contact wheel 31 is attached to shaft 28 and rotates in a counterclockwise direction when a rotational force from electric motor 27 is transmitted to shaft 28.

Ball track 25 is an open wire form to allow the ball to be visible as it is propelled through the track. The inside of ball track 25 is smooth with an inside diameter greater than a softball to permit the ball to roll freely around the track. Ball track 25 end 23 attaches to the ball entry point 20 of pitching machine 37.

In FIGS. 2A and 2B, ball track 25 forms a generally circular spiral loop above the pitching machine 37 to simulate a softball pitching motion. A ball is inserted entry point 29 of ball track 25 where it is engaged by contact wheel 31. Contact wheel 31 rotates in a counterclockwise direction and at such a speed as to propel the ball up and around ball track 25 to the exit point 23 to be introduced to entry point 20 of pitching machine 37. For a batter or catcher positioned in front of the pitching machine, the visual image of the circular, looping path of the ball passing through the track is therefore similar to the windmill throwing motion of a softball pitcher.

Figure 3B:
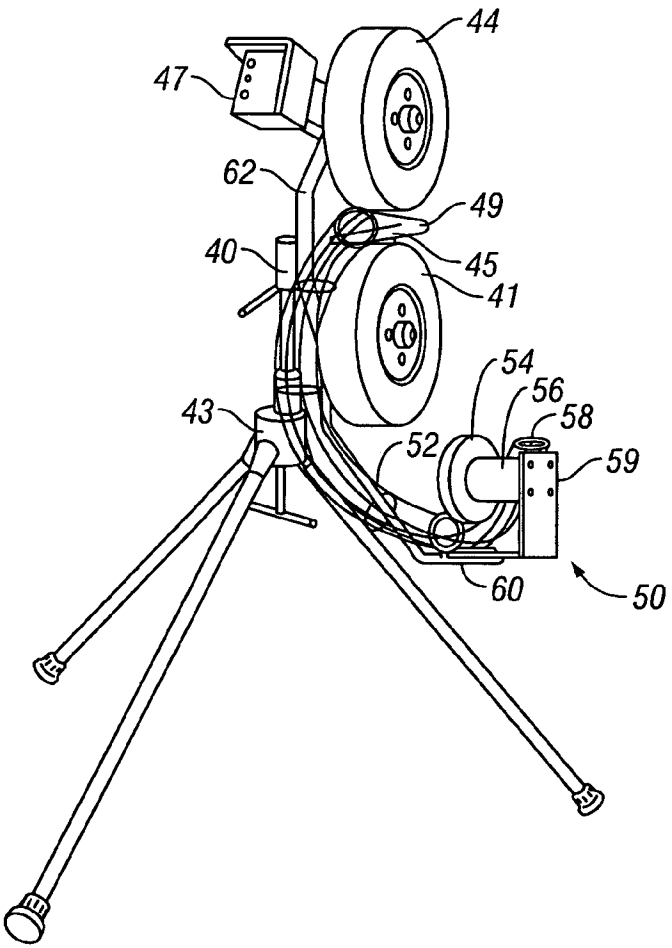
FIG. 3B is a perspective view of an embodiment according to the invention.
Figure 3A:
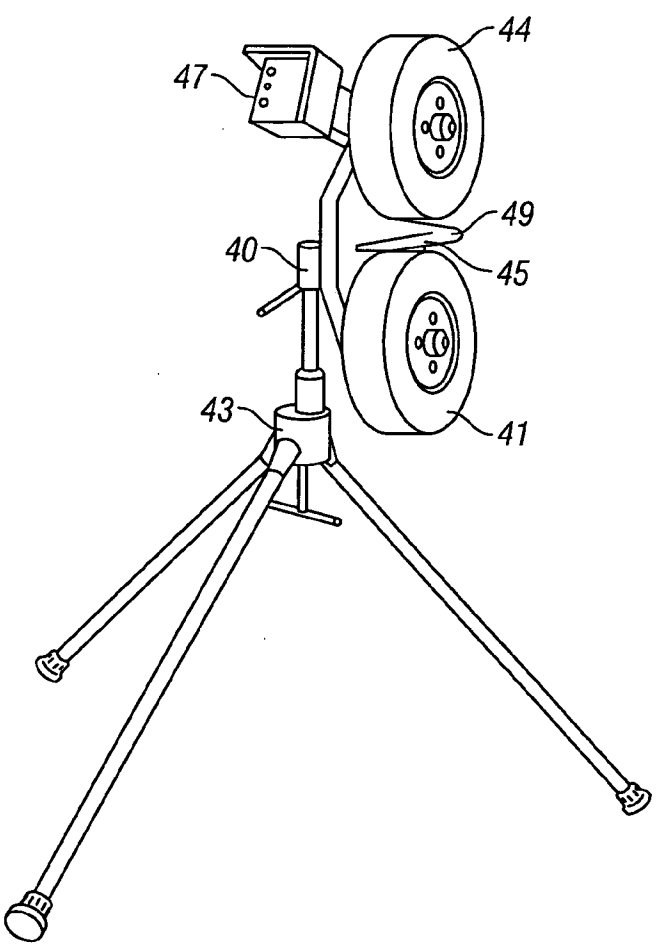
FIG. 3A is a perspective view of a pitching machine known in the art.

FIG. 3A shows a baseball pitching machine 40 as known in the art having a frame 43 and two contact wheels 41 and 44. Contact wheel 41 rotates in a clockwise direction when a rotational force from an electric motor is received. Contact wheel 44 rotates in a counterclockwise direction when a rotational force from an electric motor is received. A baseball is introduced at entry point 45, and exits the machine at exit point 49 as the rotational force from contact wheels 41 and 44 propels the baseball out of exit point 49 and away from pitching machine 40. Control pad 47 is used to control the speed of the rotation of contact wheels 41 and 44.

Another embodiment according to the invention discloses a pitching machine attachment 50 that is attached to a known pitching machine 40 such as the one shown in FIG. 3A. FIG. 3B, shows the embodiment of the pitching machine according to the invention with attachment 50. Pitching machine attachment 50 has a ball track 52 which is dimensioned and shaped to convey a ball in a semicircular path from its entry onto ball track 52 at entry point 58 to its exiting ball track 52 at exit point 62 to be received into entry point 45 of the pitching machine 40. The semicircular path of a ball being conveyed by track 52 is meant to simulate the motion and path of a pitcher's arm during the pitching of a baseball.

Attachment 50 has a frame 60 to support the attachment 50 being affixed to the pitching machine 40 below and to the side of the pitching machine 40. Attachment 50 has a contact wheel 54 positioned near entry point 58 to engage a ball and propel it around the track 52. Contact wheel 54 is attached to an electric motor 56 being held by support 59 and rotates in a clockwise direction when a rotational force from electric motor 56 is received.

Ball track 52 is an open wire form to allow the ball to be visible as it is propelled through the track. The inside of ball track 52 is smooth with an inside diameter greater than a baseball to permit the ball to roll freely around the track. Ball track 52 at end 62 attaches to the ball entry point 45 of pitching machine 40.

In FIG. 3B, ball track 52 forms a generally semicircular arc below the pitching machine 40 to simulate the path of a baseball during a pitching motion. A ball is inserted at entry point 58 of ball track 52 where it is engaged by contact wheel 54. Contact wheel 54 rotates in a clockwise direction and at such a speed as to propel the ball along the path of ball track 52 to the exit point 62 to be introduced to entry point 45 of pitching machine 40. For a batter or catcher positioned in front of the pitching machine, the visual image of the semicircular arcing path of the ball passing through the track is therefore similar to the throwing motion of a baseball pitcher.

In the embodiments shown in FIGS. 2B, 2C, and 3B, the attachments according to the invention are attached to and supported by the companion pitching machine. However, these attachments 39 and 50 could also be constructed in such a manner as to be partly or totally free standing as long as they are attached or aligned in such a manner as to feed the ball into the respective pitching machine at entry points 20 and 45. Moreover, the ball tracks 25 and 52 can also be constructed with a sectioned and/or interchangeable track and adapter connections to allow a single device to feed baseballs or softballs to pitching machines 37 and 40, or to pitching machines produced by various different manufacturers.

Figure 4B:
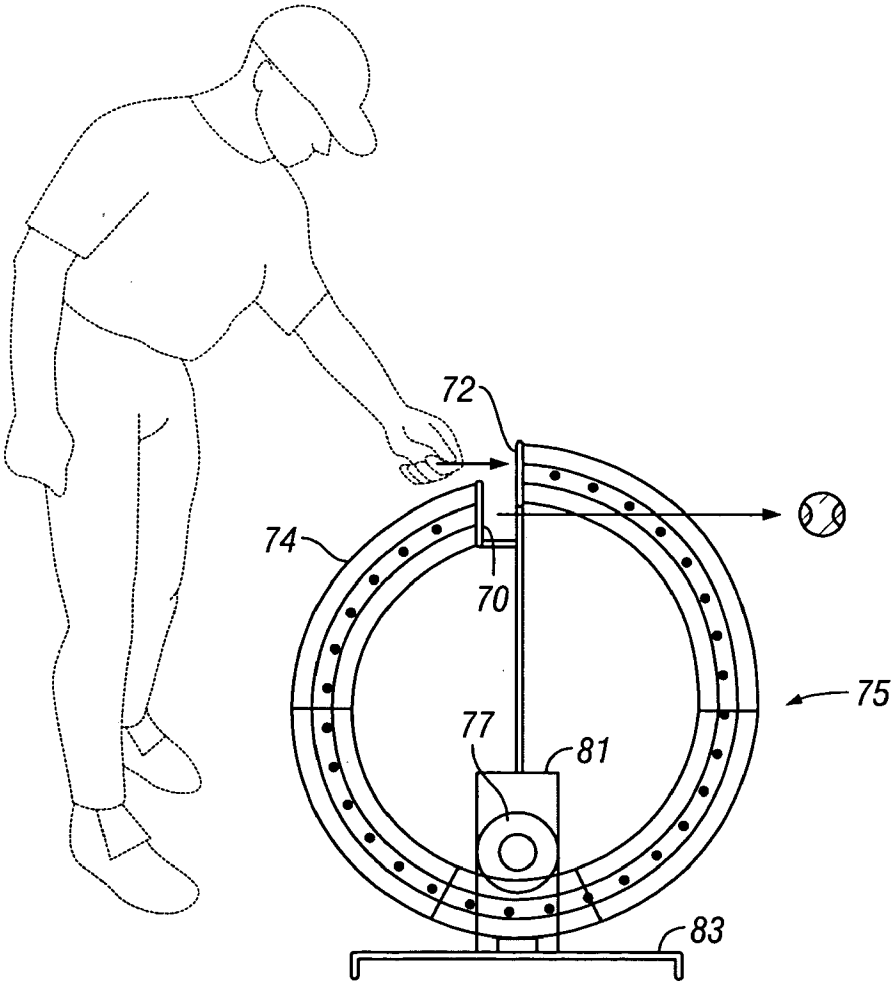
FIG. 4B is a perspective side view of an embodiment according to the invention.
Figure 4A:
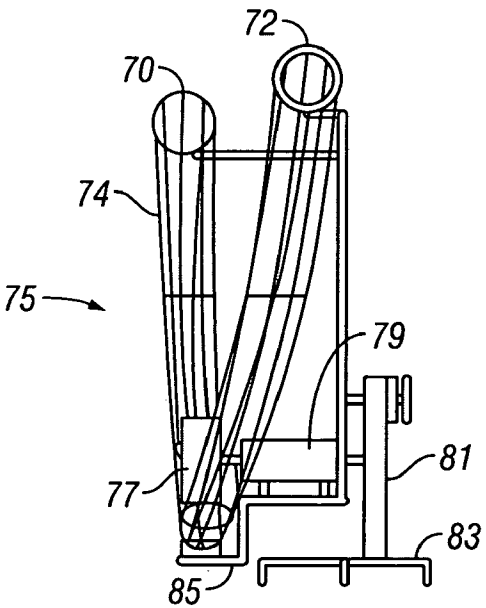
FIG. 4A is a perspective front view of an embodiment according to the invention.

FIGS. 4A and 4B, show another embodiment according to the invention. A ball throwing apparatus 75 having frame stand 81 with a base 83 and supporting an electric motor 79 with a shaft 85 connected to a contact wheel 77 in a confronting relationship with a ball track 74 is shown in FIGS. 4A and 4B. Contact wheel 77 is rotated in a clockwise direction when a rotational force from electric motor 79 is transmitted to shaft 85 and received by contact wheel 77.

Ball track 74 has an entry point 72 and an exit point 70. Ball track 74 has a generally circular spiral shape with ends 72 and 70 being offset from each other. A ball is introduced into ball track 74 at entry point 72 and conveyed by ball track 74 to contact wheel 77. Contact wheel 77, rotating in a clockwise direction, engages the ball and propels along the path of ball track 74 with sufficient velocity for the ball to exit ball track 74 at exit point 70.

The ball throwing device shown in FIGS. 4A and 4B uses one contact wheel which can limit the velocity of the ball and therefore would likely be used for "short toss" or "soft toss" ("short toss" and "soft toss" are the terms commonly used when the batting practice pitcher throws the ball from a knelling position and is vary near the batter). Also, this type of device might be used to throw lighter balls such as tennis balls or perforated plastic balls (Wiffle balls or polyballs).

The ball track 3 shown in FIGS. 1A and 1B is an open trough type track. Ball tracks 25, 52, and 74 as shown in FIGS. 2B, 2C, 3B, 4A, and 4B are a wire form construction. These constructions enable an important aspect of the invention by allowing at least a portion of a ball to be visible as it is propelled through the track. By enabling a portion of the ball to be visible as it is conveyed along the path of a track, a batter or catcher is in a more realistic position to anticipate the arrival of the ball just as the batter or catcher observes the human pitchers windup prior to release of the ball. However, the track might also be constructed using a number of other materials such as clear plastic or transparent acrylic or Plexiglas. And, the track might also be formed as a hose or tube.

The embodiments described herein show a ball being propelled through a ball with a motor and a rotating contact wheel. However, a number of other methods known in the art for applying force to the ball might also be used. A spring, a spring driven lever or a spring driven plunger could be used to inject the ball into the track. Also, a rotating wheel brush could be used in place of a contact wheel. A combustion engine might be used to rotate a wheel instead of an electric motor. Additionally, multiple wheels or types of forces might be used to propel the ball around the track. Furthermore, use of a transparent hose or tube material for the track would allow the ball to be propelled with an air blower or by sudden release of compressed air other pneumatic type of ball throwing device.

It is to be understood that while certain embodiments of this invention have been illustrated and described, it is not limited thereto, except in so far as such limitations are included in the following claims and allowable equivalents thereof.

I claim:

1. A ball pitching apparatus for pitching to a receiver, comprising:

a propelling means for propelling a ball from a first entry point to a first exit point away from the pitching apparatus in a first direction;

a ball track for introducing said ball to said first entry point of said propelling means, said ball track having a second entry point dimensioned to receive said ball and a second exit point for said introduction of said ball to said propelling means, wherein said ball track is dimensioned in a generally circular shape and constructed such that at least a portion of said ball is visible along a part of the path from said second entry point to said second exit point; and a frame means for supporting said propelling means and said ball track and for aligning said second exit point with said first entry point;

wherein said receiver positioned at said first direction in a confronting relationship to the apparatus is able to see said portion of said ball as it is conveyed along the ball track, thereby enabling said receiver to anticipate a pitching of said ball in a manner similar to an anticipation that occurs with a live ball pitcher during a windup and release of a pitch;

said apparatus further comprising a second propelling means attached to said frame means and positioned near said second entry point for engaging said ball entering said second entry point and propelling said ball past said second entry point.

2. A ball pitching apparatus for pitching to a receiver, comprising:

a propelling means for propelling a ball from a first entry point to a first exit point away from the pitching apparatus in a first direction;

a ball track for introducing said ball to said first entry point of said propelling means, said ball track having a second entry point dimensioned to receive said ball and a second exit point for said introduction of said ball to said propelling means, wherein said ball track is dimensioned in a generally circular shave and constructed such that at least a portion of said ball is visible along a part of the path from said second entry point to said second exit point; and a frame means for supporting said propelling means and said ball track and for aligning said second exit point with said first entry point;

wherein said receiver positioned at said first direction in a confronting relationship to the apparatus is able to see said portion of said ball as it is conveyed along the ball track, thereby enabling said receiver to anticipate a pitching of said ball in a manner similar to an anticipation that occurs with a live ball pitcher during windup and release of a pitch;

wherein said ball track is dimensioned in a generally circular shape and constructed such that at least a portion of said ball is visible throughout the path from said second entry point to said second exit point;

said apparatus further comprising a second propelling means attached to said frame means and positioned near said second entry point for engaging said ball entering said second entry point and propelling said ball past said second entry point.

3. An attachment for a ball pitching machine having a first entry point for receiving said ball and propelling said ball out of a first exit point away from said ball pitching machine in a first direction, said attachment comprising:

a ball track for introducing said ball to said first entry paint of said ball pitching machine, said ball track having a second entry point dimensioned to receive said ball and a second exit point for said introduction of said ball to said first entry point, wherein said ball tack is dimensioned in a generally circular shape and constructed such that at least a portion of said ball is visible along a part of the path from said second entry point to said second exit point;

a propelling means for propelling said ball through said ball track from a first engagement point to said second exit point; and a frame means for supporting said propelling means and said ball track and for aligning said second exit point with said first entry point;

wherein a receiver positioned at said first direction in a confronting relationship to said pitching machine is able to see said portion of said ball as it is conveyed along the ball track, thereby enabling said receiver to anticipate a pitching of said ball in a manner similar to an anticipation that occurs with a live ball pitcher during a windup and release of a pitch.

4. A ball pitching machine attachment according to claim 3, wherein said ball track is dimensioned in a generally circular shape and constructed such that at least a portion of said ball is visible throughout the path from said second entry point to said second exit point.

5. A ball pitching machine attachment according to claim 4 wherein said ball track is dimensioned in a generally semicircular shape.

6. A ball pitching machine attachment according to claim 3 wherein said ball track is dimensioned in a generally semicircular shape.

* * * * *